US007102284B2

(12) United States Patent
Kato et al.

(10) Patent No.: US 7,102,284 B2
(45) **Date of Patent: *Sep. 5, 2006**

(54) PHOTOMULTIPLIER

(75) Inventors: Hisaki Kato, Hamamatsu (JP); Hideto Kawai, Hamamatsu (JP)

(73) Assignee: Hamamatsu Photonics K.K., Hamamatsu (JP)

( * ) Notice: Subject to any disclaimer, the term of this patent is extended or adjusted under 35 U.S.C. 154(b) by 322 days.

This patent is subject to a terminal disclaimer.

(21) Appl. No.: 10/468,817

(22) PCT Filed: Feb. 22, 2002

(86) PCT No.: PCT/JP02/01626

§ 371 (c)(1),
(2), (4) Date: Aug. 28, 2003

(87) PCT Pub. No.: WO02/067288

PCT Pub. Date: Aug. 29, 2002

(65) Prior Publication Data

US 2004/0100193 A1 May 27, 2004

(30) Foreign Application Priority Data

Feb. 23, 2001 (JP) ..... 2001-048879

(51) Int. Cl.

| | |
|---|---|
| ***H01J 43/04*** | (2006.01) |
| ***H01J 43/18*** | (2006.01) |
| ***H01J 43/00*** | (2006.01) |
| ***H01J 43/30*** | (2006.01) |
| ***H01J 40/14*** | (2006.01) |

(52) U.S. Cl. ..... 313/532; 313/533; 313/103 CM; 250/214 VT; 250/207

(58) Field of Classification Search ..... 313/103 R, 313/532–536, 105 R, 538, 525, 103 CM, 313/104, 105 CM, 540, 537; 250/366, 214 VT, 250/207

See application file for complete search history.

(56) References Cited

U.S. PATENT DOCUMENTS

| | | | | |
|---|---|---|---|---|
| 5,510,674 | A * | 4/1996 | Kyushima et al. | 313/533 |
| 5,646,477 | A * | 7/1997 | Yamagishi | 313/365 |
| 5,801,511 | A * | 9/1998 | Kyushima et al. | 313/532 |
| 5,917,281 | A * | 6/1999 | Shimoi et al. | 313/533 |
| 5,936,348 | A * | 8/1999 | Shimoi et al. | 313/533 |
| 6,538,399 | B1 * | 3/2003 | Shimoi et al. | 315/500 |
| 6,794,629 | B1 * | 9/2004 | Kato et al. | 250/214 VT |

FOREIGN PATENT DOCUMENTS

| | | |
|---|---|---|
| JP | A 55-146854 | 11/1980 |
| JP | B2 58-41617 | 9/1983 |
| JP | A 61-273826 | 12/1986 |
| JP | A 5-290793 | 11/1993 |

(Continued)

*Primary Examiner*—Edward J. Glick
*Assistant Examiner*—Irakli Kiknadze
(74) *Attorney, Agent, or Firm*—Oliff & Berridge, PLC

(57) ABSTRACT

In a photomultiplier, focusing pieces of a focusing electrode are formed with sufficient height that the photocathode in the adjacent channels cannot be viewed from the first and second stage dynodes of each channel in order to prevent light reflected from the first and second stage dynodes from returning to the adjacent channels. This construction prevents the photocathode from emitting undesired electrons, thereby suppressing crosstalk. Further, by arranging condensing lenses on the outer surface of a light-receiving faceplate in correspondence with each channel, light is reliably condensed in each channel. Further, an oxide film formed over the surface of the focusing pieces prevents the reflection of light off the focusing pieces.

13 Claims, 5 Drawing Sheets

FOREIGN PATENT DOCUMENTS

| | | |
|---|---|---|
| JP | B2 6-27845 | 4/1994 |
| JP | A 11-329339 | 11/1999 |
| JP | A 11-345587 | 12/1999 |
| JP | A 2000-149863 | 5/2000 |

* cited by examiner

PHOTOMULTIPLIER

TECHNICAL FIELD

The present invention relates to a multichannel photomultiplier for multiplying electrons through each of a plurality of channels.

BACKGROUND ART

A multichannel photomultiplier 100 shown in FIG. 1 is well known in the art. A conventional photomultiplier 100 includes a photocathode 103*a* disposed on an inner side of a light-receiving faceplate 103. Electrons are emitted from the photocathode 103*a* in response to incident light on the photocathode 103*a*. A focusing electrode 113 includes a plurality of focusing pieces 123 for focusing electrons emitted from the photocathode 103*a* in each of a plurality of channels. An electron multiplying section 109 includes a plurality of stages of dynodes 108 for multiplying the focused electrons for each corresponding channel. An anode 112 collects electrons multiplied in multiple stages for each channel to generate an output signal for each channel.

DISCLOSURE OF THE INVENTION

The inventors of the present invention discovered that the conventional photomultiplier 100 described above could not sufficiently distinguish optical signals for each channel in measurements of higher precision due to crosstalk.

In view of the foregoing, it is an object of the present invention to provide a photomultiplier capable of suppressing crosstalk between channels in order to improve the capacity for distinguishing optical signals of each channel.

In order to attain the above object, the present invention provides a photomultiplier a light-receiving faceplate; a wall section forming a vacuum space with the light-receiving faceplate; a photocathode formed inside the vacuum space on an inner surface of the light-receiving faceplate and having a plurality of channels, wherein each channel emits electrons in response to light incident thereon; an electron multiplying section disposed inside the vacuum space and having a plurality of secondary electron multiplying pieces having a one-on-one correspondence with the plurality of channels for multiplying electrons emitted from each channel in the photocathode for the corresponding channel; an anode disposed within the vacuum space for generating an output signal for each channel based on the electrons multiplied for each channel by the electron multiplying section; and a focusing electrode disposed in the vacuum space and having a plurality of focusing pieces, wherein each pair of adjacent focusing pieces defines an opening corresponding to one channel, such that electrons emitted from corresponding channel of the photocathode are focused by the opening and guided to the corresponding channel of the electron multiplying section, and each pair of adjacent focusing pieces prevents light reflected off the surface of secondary electron multiplying pieces in the corresponding channel of the electron multiplying section from reaching channels adjacent to the corresponding channel of the photocathode.

In the photomultiplier of the present invention having this construction, light incident on an arbitrary channel of the photocathode causes electrons to be emitted from the corresponding channel. The electrons are converged in each channel by the corresponding pair of adjacent focusing pieces and guided to the corresponding channel of the electron multiplying section to be multiplied. The anode outputs an output signal corresponding to the channel. Here, even if light incident on any channel in the photocathode passes through the photocathode and reflects off the surface of a secondary electron multiplying piece in the corresponding channel of the dynode, the reflected light is blocked by the corresponding pair of adjacent focusing pieces, thereby preventing the reflected light from reaching channels adjacent to the corresponding channel of the photocathode.

With the photomultiplier of the present invention, therefore, the focusing pieces of the focusing electrode prevent light reflected off the secondary electron multiplying pieces in any channel of the electron multiplying section from returning to the adjacent channel in the photocathode. Accordingly, the photomultiplier of the present invention can suppress crosstalk caused by light passing through the photocathode and can improve the ability for distinguishing optical signals of each channel.

Here, each pair of adjacent focusing pieces preferably has a size and shape to prevent the surface of secondary electron multiplying pieces in the corresponding channel of the electron multiplying section from having an unobstructed view of channels adjacent to the corresponding channel of the photocathode.

With such a size and shape, the focusing pieces can reliably prevent light reflected off the secondary electron multiplying pieces in any channel of the electron multiplying section from returning to the adjacent channel of the photocathode, thereby suppressing crosstalk.

For example, each focusing piece preferably has a prescribed height extending substantially orthogonal to the photocathode and a prescribed width extending substantially parallel to the photocathode, such that the prescribed height is longer than the prescribed width.

With such a shape, the focusing pieces can reliably prevent light reflected off the secondary electron multiplying pieces in any channel of the electron multiplying section from returning to the adjacent channel of the photocathode, thereby suppressing crosstalk.

The electron multiplying section includes a plurality of stages of dynodes that are arranged sequentially between the focusing electrode and the anode. Each stage of the dynodes has a plurality of secondary electron multiplying pieces corresponding one-on-one to the plurality of channels. When multiplying electrons emitted from each channel in the photocathode for the corresponding channel, the plurality of stages of dynodes has at least a first stage dynode positioned in sight of the photocathode, that is, in direct view of the photocathode along a path extending linearly therefrom. Light passing through the photocathode has the potential of striking and reflecting off of at least the first stage dynode positioned in view of the photocathode in this way. Accordingly, each pair of adjacent focusing pieces preferably has a size and shape for preventing reflected light from reaching channels adjacent to the corresponding channel of the photocathode, when light passes through a corresponding channel of the photocathode and reflects off the surface of the secondary electron multiplying pieces in the corresponding channel of at least the first stage dynode in view of the photocathode. For example, each pair of adjacent focusing pieces preferably has a size and shape to prevent the surface of the secondary electron multiplying pieces in at least the first stage dynode that has a direct line of view to the corresponding channel of the photocathode from having an unobstructed view of channels adjacent to the corresponding channel of the photocathode.

By preventing light reflected off dynodes in stages that can receive incident light via the photocathode from returning to the adjacent channels, it is possible to suppress crosstalk.

The electron multiplying section is preferably a stacked type including a plurality of dynodes stacked in a plurality of stages. This type of electron multiplying section can reliably multiply incident electrons for each channel.

Preferably, the light-receiving faceplate includes a plurality of partitioning parts. Each of the partitioning parts corresponds to each one of the plurality of channels. The partitioning parts prevents light incident on one of the channels in the light-receiving faceplate from entering a channel adjacent to the one of the channels in the light-receiving faceplate.

By providing the partitioning parts to prevent light incident on one channel in the light-receiving faceplate from entering an adjacent channel, the present invention can further suppress crosstalk.

The partitioning parts are preferably formed of a light-absorbing glass, for example. Since the light-absorbing glass absorbs light incident on one channel that reaches the partitioning part, this construction can prevent light from entering the adjacent channels and can reliably suppress crosstalk.

It is preferable that each pair of the adjacent focusing pieces focuses electrons emitted from a prescribed region within the corresponding channel of the photocathode, and that the light-receiving faceplate includes condensing means for condensing light incident on any position within each channel to a prescribed region in the corresponding channel of the photocathode.

Each pair of the adjacent focusing pieces focuses electrons emitted from the prescribed region within the corresponding channel of the photocathode to guide the electrons to the corresponding channel of the electron multiplying section. The condensing means condenses light incident on any position in a channel of the light-receiving faceplate to a prescribed region of the corresponding channel in the photocathode. Electrons converted from light at the prescribed region are reliably focused by the corresponding pair of adjacent focusing pieces and are guided and multiplied in the corresponding channel of the electron multiplying section. Hence, light incident on each channel is effectively multiplied.

The condensing means preferably includes a plurality of condensing lenses disposed on an outer surface of the light-receiving faceplate in a one-on-one correspondence with the plurality of channels.

When the condensing means has condensing lenses arranged on the outer surface of the light-receiving faceplate corresponding to each channel in this way, the condensing lenses can reliably condense light for each channel.

Alternatively, the condensing means may include a plurality of condensing lens-shaped parts formed on an outer surface of the light-receiving faceplate in a one-on-one correspondence with the plurality of channels.

By forming a plurality of condensing lens-shaped parts on the outer surface of the light-receiving faceplate itself, it is possible to condense light reliably for each channel through a simple construction.

Further, the surfaces of each focusing piece are preferably treated with an antireflection process.

Therefore, even when light passes through the photocathode and reaches the focusing pieces, the light is prevented from reflecting off of the focusing pieces. Hence, this construction suppresses crosstalk that can occur when electrons are emitted in response to light reflected from the focusing pieces and striking the photocathode and the electrons enter the adjacent channel.

BEST MODE FOR CARRYING OUT THE INVENTION

Figure 1:
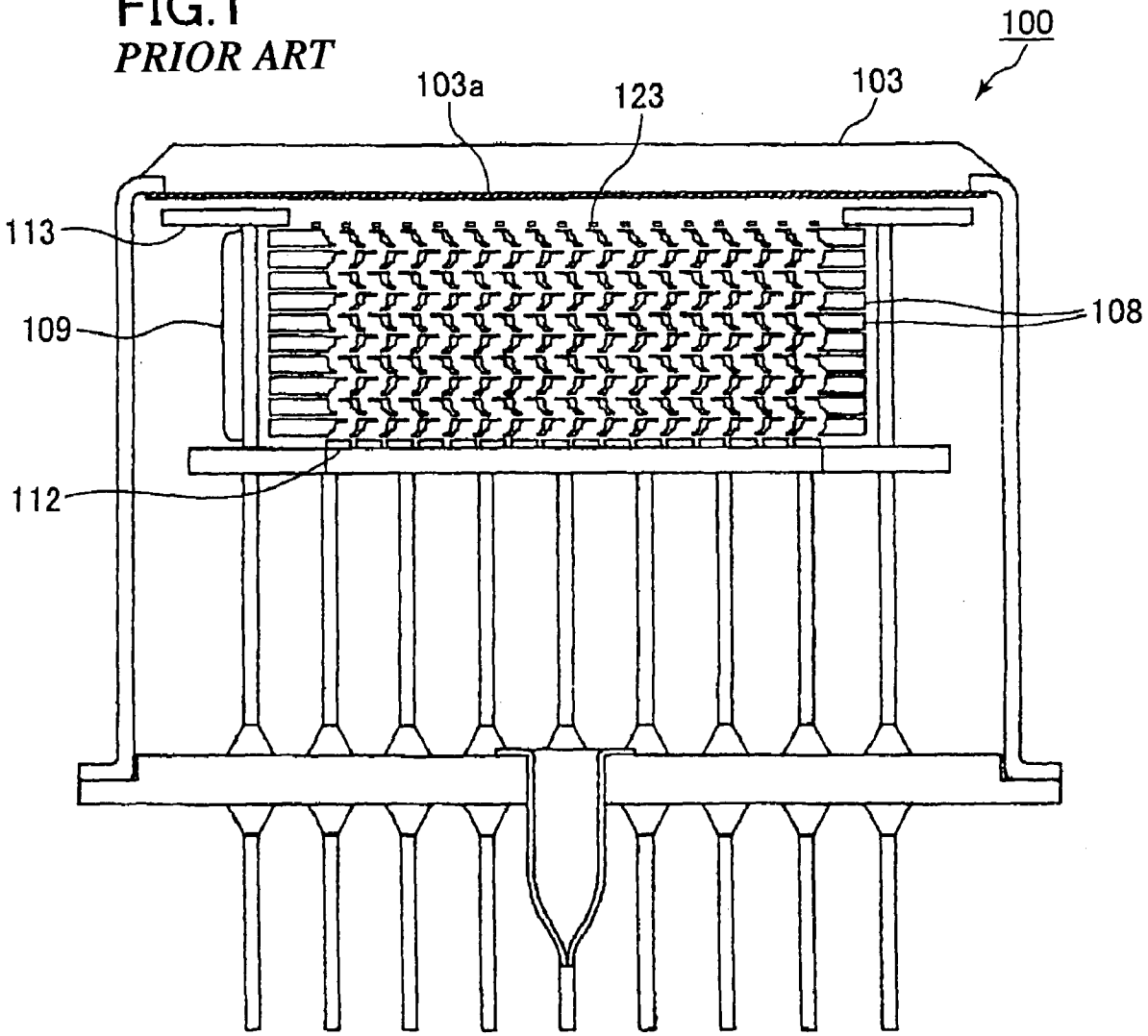
FIG.1 PRIOR ART
FIG. 1 is a cross-sectional view showing the overall structure of a conventional photomultiplier.

A photomultiplier according to preferred embodiments of the present invention will be described with reference to FIGS. 2 through 5, wherein like parts and components are designated by the same reference numerals to avoid duplicating description.

Figure 2:
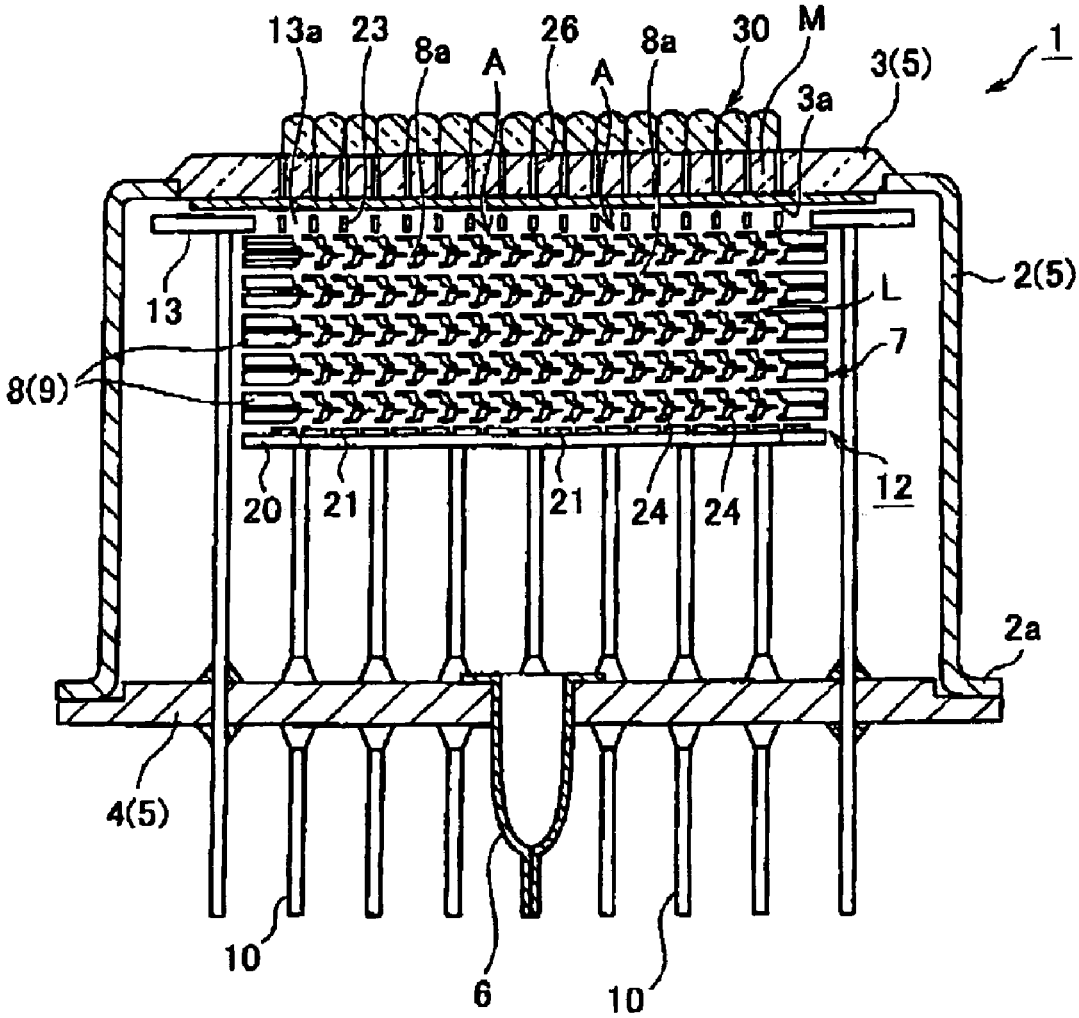
FIG. 2 is a cross-sectional view showing the overall structure of a photomultiplier according to a preferred embodiment of the present invention.

As shown in FIG. 2, a photomultiplier 1 according to a preferred embodiment includes a metal side tube 2 having a substantially squared cylindrical shape. A glass light-receiving faceplate 3 is fixed to one open end of the side tube 2 in the axial direction of the tube. A photocathode 3*a* for converting light to electrons is formed on the inner surface of the light-receiving faceplate 3. The photocathode 3*a* is formed by reacting alkali metal vapor with antimony that has been deposited on the light-receiving faceplate 3. A flange part 2*a* is formed on the other open end of the side tube 2 in the axial direction of the side tube 2. A peripheral edge of a metal stem 4 is fixed to the flange part 2*a* by welding such as resistance welding. The assembly of the side tube 2, the light-receiving faceplate 3, and the stem 4 forms a hermetically sealed vessel 5.

A metal evacuating tube 6 is fixed in a center of the stem 4. The evacuating tube 6 serves both to evacuate the hermetically sealed vessel 5 with a vacuum pump (not shown) after the photomultiplier 1 has been assembled and to introduce alkali metal vapor into the hermetically sealed vessel 5 when the photocathode 3*a* is formed. A plurality of stem pins 10 penetrates the stem 4. The stem pins 10 include a plurality (ten in this example) of dynode stem pins 10, and a plurality (sixteen in this example) of anode stem pins.

A layered electron multiplier 7 having a block shape is fixed inside the hermetically sealed vessel 5, The electron multiplier 7 has an electron multiplying section 9 in which ten layers (ten stages) of dynodes 8 are stacked. The dynodes B are formed of stainless steel, for example. The electron multiplier 7 is supported in the hermetically sealed vessel 5 by the plurality of stem pins 10 disposed in the stem 4, Each dynode 8 is electrically connected to a corresponding dynode stem pin 10.

A plate-shaped multipolar anode 12 is disposed on the bottom of the electron multiplier 7. The anode 12 is constructed of a plurality (sixteen, for example) of anode pieces 21 arranged on a ceramic substrate 20.

The electron multiplier 7 further includes a plate-shaped focusing electrode 13 disposed between the photocathode 3*a* and the electron multiplying section 9. The focusing electrode 13 is formed of stainless steel, for example. The focusing electrode 13 includes a plurality (seventeen in this embodiment) of linear focusing pieces 23 arranged parallel to each other. Slit-shaped openings 13*a* are formed between adjacent focusing pieces 23. Accordingly, a plurality (sixteen in this embodiment) of the slit-shaped openings 13*a* is arranged linearly in a common direction (from side to side in FIG. 2). A plurality (sixteen) of regions, each of which faces the corresponding one of many (sixteen) openings 13*a*, are formed in the light-receiving faceplate 3 and the photocathode 3*a* as channel regions. Hence, the plurality (sixteen) of channel regions M is arranged straight in a common direction (from side to side in FIG. 2).

Similarly, each stage of the dynodes 8 has a plurality (seventeen in this embodiment) of linear secondary electron emission pieces 24 arranged parallel to one another. Slit-shaped electron multiplying holes 8*a* are formed between adjacent secondary electron emission pieces 24. Hence, a plurality (equal in number to the slit-shaped openings 13*a*; sixteen in this embodiment) of the slit-shaped electron multiplying holes 8*a* is arranged straight in a common direction (from side to side in FIG. 2).

Electron multiplying paths L are formed by aligning the electron multiplying holes 8*a* in each stage of the dynodes 8. Single channels A are formed by the one-on-one correspondence between the electron multiplying paths L, the slit-shaped openings 13*a*, and the channel regions M in the light-receiving faceplate 3 and photocathode 3*a*. Accordingly, a plurality (sixteen) of the channels A is formed by the plurality (sixteen) of channel regions M in the light-receiving plate 3 and the photocathode 3*a*, the plurality (sixteen) of slit-shaped openings 13*a* in the focusing electrode plate 13, and the plurality (sixteen) of electron multiplying holes 8*a* in each stage of the electron multiplying section 9. The channels A are arranged straight in a common direction (from side to side in FIG. 2).

The anode pieces 21 of the anode 12 are arranged on the substrate 20 in a one-on-one correspondence with the channels A. Each anode piece 21 is connected to a corresponding anode stem pin 10. This construction enables individual outputs of the channels to be extracted through the anode stem pins 10.

As described above, the electron multiplier 7 has a plurality (sixteen for example) of the channels A arranged straight. A bleeder circuit not shown in the drawings supplies a prescribed voltage to the electron multiplying section 9 and the anode 12 via the stem pins 10. The same voltage potential are applied to the photocathode 3*a* and the focusing electrode 13. Voltages are also applied to each of the ten stages of the dynodes 8 and the anode 12 so that each of their potentials is increasing in order from the first stage nearest the photocathode 3*a* through the tenth stage nearest the anode 12 to the anode 12.

With this construction, light that passes through the light-receiving faceplate 3 and strikes an arbitrary position on the photocathode 3*a* is converted to electrons. These electrons are injected into the corresponding channels A. In the channels A, the electrons are focused when passing through the slit-shaped openings 13*a* and multiplied by each stage of the dynodes 8 while passing through the electron multiplying paths L of the dynodes 8. subsequently the electrons are emitted from the electron multiplying section 9. Hence, electrons that have been multiplied through many stages are impinged on the corresponding anode piece 21. The anode piece 21 corresponding to the prescribed channel A outputs a prescribed output signal for individually indicating the amount of light injected onto a corresponding channel position of the light-receiving faceplate 3.

In the preferred embodiment, various countermeasures are undertaken against crosstalk in order to better differentiate optical signals for each channel A.

(Counter measures for crosstalk in the light-receiving faceplate)

Figure 3:
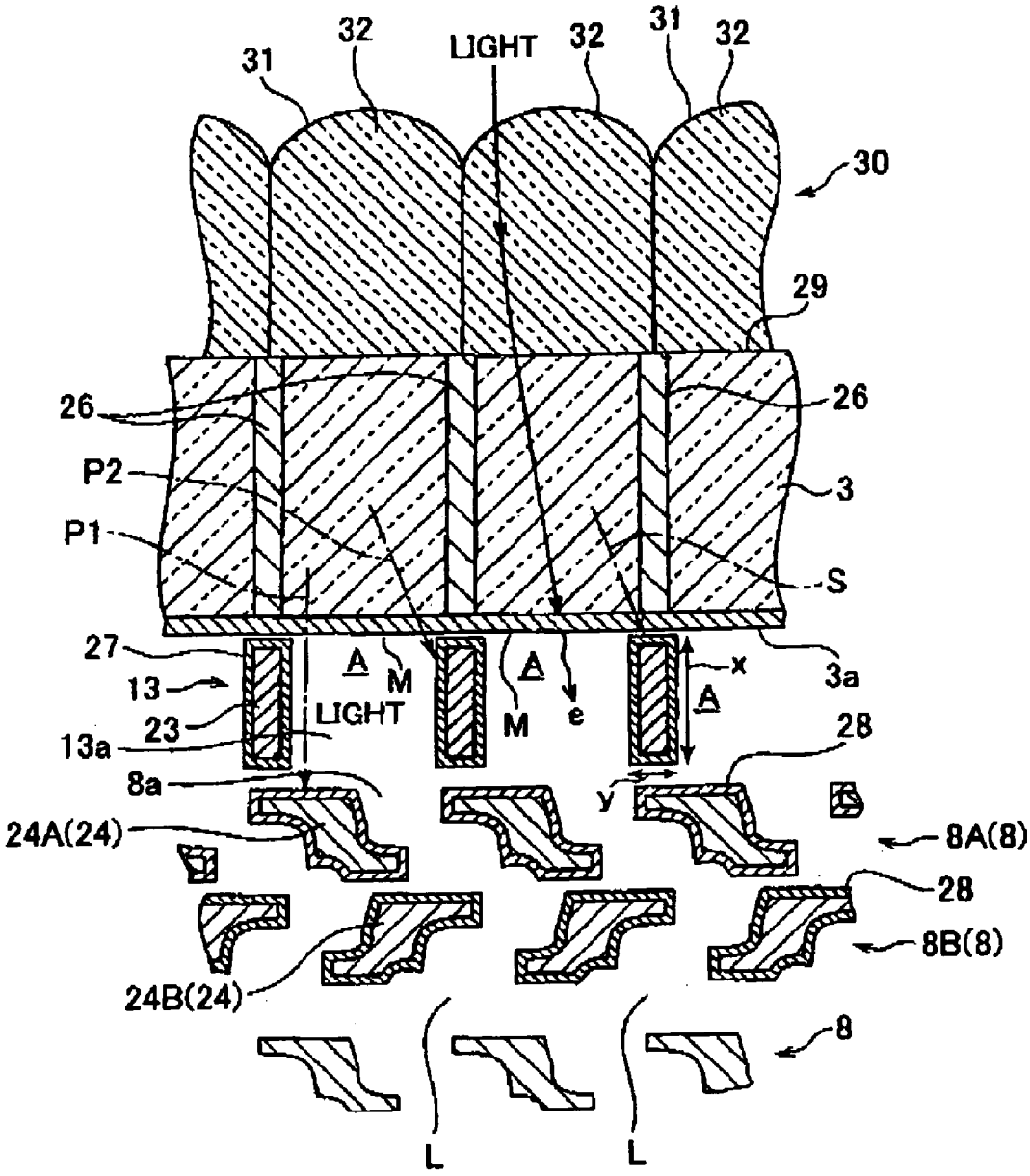
FIG. 3 is an enlarged cross-sectional view showing the relevant parts of the photomultiplier in FIG. 2.

In the preferred embodiment, partitioning parts 26 that are formed of light-absorbing glass are embedded in the light-receiving faceplate 3 in correspondence with each channel A, as shown in FIGS. 2 and 3, as a counter measure for crosstalk in the light-receiving faceplate. Hence, each partitioning part 26 is disposed at a position corresponding to one of the focusing pieces 23. As a result, the partitioning parts 26 partition the light-receiving faceplate 3 for each channel A and can appropriately prevent crosstalk in the light-receiving faceplate 3.

Here, the partitioning part 26 is configured of a thin plate of glass that has been colored (a black color, for example) for absorbing as much light as possible.

Hence, the partitioning part 26 is preferably configured of a light-absorbing glass, and particularly a black-colored glass. Since light-absorbing glass, and particularly black-colored glass, does not have optical transparency, the partitioning part 26 can prevent any light from entering the adjacent channels. Further, light-absorbing glass, and particularly black-colored glass, can absorb light injected at a slight angle in relation to the light-receiving faceplate 3 that strikes the partitioning parts 26 obliquely, thereby preventing such obliquely incident light from being guided to the photocathode 3*a*. Hence, when nonparallel rays are incident on the light-receiving faceplate 3 and pass therethrough, the partitioning parts 26 can collimate the parallel rays into approximately parallel rays. Accordingly, it is possible to inject substantially parallel rays of light onto the photocathode 3*a*.

The partitioning parts 26 may also be constructed of a light reflecting glass formed of a white-colored glass. The partitioning parts 26 constructed of light reflecting glass reflect light incident thereon, thereby preventing the incident light from entering the adjacent channels. However, since white glass has optical transparency, a portion of the light may enter adjacent channels. Therefore, it is preferable to use black-colored glass, which does not allow the passage of light. Further, since the white-colored glass reflects light, even light injected on the partitioning parts 26 at an oblique angle of incidence is guided to the photocathode 3*a*. Accordingly, white-colored glass does not achieve the same collimating effects as light-absorbing glass such as black-colored glass. Therefore, the light-absorbing glass, such as black-colored glass, is preferable when the objective is to guide only substantially parallel rays to the photocathode 3*a*.

(Counter Measures Against Crosstalk in the Focusing Electrode 13 and the Electron Multiplying Section 9)

The inventors of the present invention also noticed that light incident on the photocathode 3*a* sometimes passes therethrough and considered the effects of the above light.

The inventors conducted experiments using the conventional photomultiplier 100 (FIG. 1). Each focusing piece 123 of the focusing electrode 113 has a substantially rectangular cross-section in which a height x (extending substantially orthogonal to the photocathode 103*a*) in the axial direction of the tube is smaller than a width y (extending substantially parallel to the photocathode 103*a*) of the focusing pieces 123 (for example, a height x of 0.083 mm and a width y of 0.18 mm).

The inventors discovered the following from these experiments. In some cases, light incident on the light-receiving faceplate 103 at a position corresponding to an arbitrary channel passed through the photocathode 103*a*. Sometimes this light reflected off the focusing pieces 123 or the dynodes 108, and electrons emitted when the reflected light struck the photocathode 103*a* entered the adjacent channel. In other cases, unexpected light directly entered the adjacent channel after passing through the photocathode 103*a* and reflected off the focusing electrode 113 or the dynodes 108, producing electrons from the photocathode 103*a*. Crosstalk occurred as a result of these incidents.

Therefore, in the preferred embodiment, the surface of each focusing piece 23 is subjected to an antireflection process to prevent the focusing pieces 23 from reflecting light. More specifically, an oxide film 27 is formed on the surface of the focusing pieces 23, as shown in FIG. 3. Therefore, even when light passing through the photocathode 3*a* is incident on the focusing pieces 23, as shown by an arrow S in FIG. 3, the light is not reflected off the focusing pieces 23. Since reflected light is not generated even when light incident in an arbitrary channel A of the light-receiving faceplate 3 passes through the photocathode 3*a* and strikes the focusing pieces 23, this construction prevents the emission of undesired electrons caused by reflected light entering the adjacent channel of the photocathode 3*a*.

The following is a description of the method for producing the focusing electrode 13 that includes a plurality of the focusing pieces 23 coated with the oxide film 27. As when a conventional focusing electrode 13 is created, an electrode plate is created by etching a desired electrode pattern in stainless steel. After washing the electrode plate, the plate is treated with hydrogen to exchange gas in the electrode plate with hydrogen. Next, hydrogen is removed from the electrode plate by maintaining the plate in an oxidation furnace under vacuum and at a high temperature (800–900 degrees C.). In this way a plate-shaped focusing electrode 13 including a plurality of the focusing pieces 23 is produced in a method similar to the conventional manufacturing method. Next, oxygen is rapidly introduced into the oxidation furnace until the furnace reaches about atmospheric pressure. In other words, by rapidly introducing oxygen, a black-colored oxide film 27 is formed over the entire surface of the focusing electrode 13.

The electron multiplying section 9 of the preferred embodiment includes ten stages of dynodes 8 arranged in multiple layers. As shown in FIG. 3, the dynodes 8 include dynodes 8A and 8B positioned in the first and second stages nearest the photocathode 3*a*. Secondary electron emission pieces 24A and 24B of the first and second stage dynodes 8A and 8B are positioned in direct view of the photocathode 3*a*. In other words, the secondary electron emission pieces 24A and 24B in the first and second stage dynodes 8A and 8B are arranged on a path extending linearly from the photocathode 3*a* at positions facing directly the photocathode 3*a*. However, since the electron multiplying paths L extend in a meandering course, the third through tenth stage dynodes 8 cannot be viewed from the photocathode 3*a*. Accordingly, light passing through the photocathode 3*a* has the potential of being reflected back toward the photocathode 3*a* only off of the secondary electron emission pieces 24A and 24B in the first and second stages of the dynodes 8.

Therefore, in the preferred embodiment, light is prevented from reflecting off the secondary electron emission pieces 24A and 24B by performing an antireflection process on the secondary electron emission pieces 24A and 24B of the first and second stage dynodes 8A and 8B. Specifically, as shown in FIG. 3, an oxide film 28 is formed over the surfaces of the secondary electron emission pieces 24A and 24B. Therefore, this construction prevents the reflection of light, even when light passes through the photocathode 3*a*, as shown by the arrow P1 in FIG. 3, and strikes the secondary electron emission pieces 24A and 24B. In other words, reflected light is not generated by light incident on an arbitrary channel of the light-receiving faceplate 3, even when the light passes through the photocathode 3*a* and strikes the secondary electron emission pieces 24A or 24B of the same channel in the first stage dynode 8A or the second stage dynode 8B, as shown by the arrow P1. Hence, this construction can prevent the emission of undesired electrons in response to reflected light entering the adjacent channel of the photocathode 3*a*.

The oxide film 28 can be formed on the first and second stage dynodes 8A and 8B according to the same method for forming the oxide film 27 on the focusing electrode 13. After the oxide film 28 is formed on the secondary electron emission pieces 24A and 24B of the first and second stage dynodes 8A and 8B, antimony is deposited and reacted with an alkali metal vapor, as in the conventional method. Since, the black color of the oxide film 28 is maintained, even when antimony or alkali metal is deposited thereon, the secondary electron emission pieces 24A and 24B can maintain an antireflection property. Since the oxide film 28 is not completely insulated, the secondary electron emission pieces 24A and 24B have a desired secondary electron multiplying ability.

As an additional countermeasure for crosstalk in the preferred embodiment, the focusing pieces 23 block reflected light, even when light passes through the photocathode 3*a*, as shown in FIG. 3, strikes the secondary electron emission pieces 24A and 24B, and is partially reflected. The focusing pieces 23 prevent the reflected light from being reflected into the adjacent channel of the photocathode 3*a*.

More specifically, each focusing piece 23 of the focusing electrode 13 has a substantially rectangular cross section with a long vertical length, such that a height x (extending substantially orthogonal to the photocathode 3*a*) in the axial direction of the tube shown in FIG. 3 is longer than a width y (extending substantially parallel to the photocathode 3*a*). The height x is set large enough that only the current channel of the photocathode 3*a* can be seen from the surfaces of the secondary electron emission pieces 24A and 24B of the first and second stage dynodes 8A and 8B for each channel A, and not adjacent channels. With this construction, even if a small amount of incident light P1 reflects off of the secondary electron emission pieces 24A and 24B, this reflected light is blocked by the focusing pieces 23 and cannot reflect back into the adjacent channel of the photocathode 3*a*. The focusing pieces 23 also block an incident light P2 that tries to directly enter the adjacent channel after passing through the photocathode 3*a*, thereby preventing light from directly entering the adjacent channels. Hence, this construction prevents electrons from being emitted from the photocathode 3*a* in response to unexpected light reflected off the secondary electron emission pieces 24A and 24B of the first and second stage dynodes 8A or 8B. In this way, crosstalk in the slit-shaped openings 13*a* is further prevented in the preferred embodiment by reducing the angle of unobstructed view from the electron multiplying section 9 to the photocathode 3*a*.

If, for example, the height x is 0.083 mm and the width y 0.18 mm in the conventional photomultiplier (FIG. 1), then the height x is set to 0.5 mm and the width y to 0.2 mm in the preferred embodiment. Since the height x of the focusing pieces 23 in the axial direction is increased, the top of each focusing piece 23 is closer to the photocathode 3*a* than that of the conventional device. Specifically, the distance between the top of the focusing pieces 23 and the photocathode 3*a* is within a range from 0.8 mm through 1 mm in the conventional device. However, in the preferred embodiment, the distance is within a range from 0 mm through 0.35 mm. With this construction, the adjacent channels in the photocathode 3*a* are not in view from the secondary electron emission pieces 24A and 24B of the first and second stage dynodes 8A and 8B. Since the same potential is applied to both the photocathode 3*a* and the focusing pieces 23, it is not a problem to set the distance between the two to 0 mm, that is, to place the focusing pieces 23 and the photocathode 3*a* in direct contact with each other. Placing the top of the focusing pieces 23 in direct contact with the photocathode 3*a* can more reliably prevent light reflected from the first and second stage dynodes 8A and 8B from entering the adjacent channels and can more reliably prevent the incident light P2 passing through the photocathode 3*a* from directly entering the adjacent channels.

While the tops of the focusing pieces 23 are positioned near the photocathode 3*a* in the preferred embodiment by constructing each focusing piece 23 with a taller height x in the axial direction, the distance between the bottoms of the focusing pieces 23 and the first stage dynode 8A is set equal to that of the conventional photomultiplier. Specifically, the distance between the bottoms of the focusing pieces 23 and the first stage dynode 8A is set to 0.15 mm, identical to that in the conventional photomultiplier (FIG. 1). However, in addition to placing the tops of the focusing pieces 23 in contact with the photocathode 3*a*, it is possible to place the bottoms of the focusing pieces 23 in contact with the first stage dynode 8A by increasing the height x of the focusing pieces 23 in the axial direction. Any arrangement and construction is possible, provided that the adjacent channels of the photocathode 3*a* cannot be viewed from the secondary electron emission pieces 24A and 24B of the first and second stage dynodes 8A and 8B by increasing the height x of the focusing pieces 23 in the axial direction.

In the preferred embodiment, a light-condensing member 30 is fixed to an outer surface 29 of the light-receiving faceplate 3 by an adhesive. The light-condensing member 30 functions to inject external light reliably into each channel A. Specifically, the light-condensing member 30 includes a plurality (equivalent to the number of the channels A; sixteen in this embodiment) of glass light-condensing lens units 32. Each light-condensing lens unit 32 has a single convex lens surface 31. The plurality of the light-condensing lens units 32 are aligned in a common direction (from side to side in FIGS. 2 and 3) and fixed to the outer surface 29 of the photocathode 3*a*.

The light-condensing member 30 with this construction, can reliably inject light onto the photocathode 3*a* by condensing external light between the partitioning parts 26 through the convex lens surfaces 31. Accordingly, increasing light-condensing ability is a reliable countermeasure against crosstalk.

Each pair of adjacent focusing pieces 23 of the focusing electrode 13 generates an electron lens effect corresponding to the shape of the focusing pieces 23. Specifically, each focusing piece 23 generates an electron lens of a shape defined by the shape of the focusing piece 23. As described above, since the height x of the focusing pieces 23 in the axial direction is increased in the preferred embodiment, the generated electron lens can only sufficiently focus electrons generated within a prescribed narrow region (hereinafter referred to as the "effective region") positioned substantially in the center of the total region of each channel in the photocathode 3*a* (each channel region M). Accordingly, each light-condensing lens unit 32 in the preferred embodiment is configured to collect incident light on arbitrary positions within the corresponding channel into the effective region in the center portion of the channel. Electrons generated through photoelectric conversion at this effective region are effectively focused by the corresponding pair of focusing pieces 23 and guided to the corresponding electron multiplying path L of the electron multiplying section 9.

The light-condensing lens units 32 in the light-condensing member 30 may be replaced by light guides, such as optical fibers.

As described above, the oxide film 27 is formed over the surface of the focusing pieces 23 in the photomultiplier 1 of the preferred embodiment. Accordingly, the oxide film 27 prevents the reflection of light from the focusing pieces 23, ensuring that undesired electrons are not emitted from the photocathode 3*a* in response to such reflected light.

Further, the oxide film 28 is formed over the surfaces of the secondary electron emission pieces 24A and 24B in the first and second stage dynodes 8A and 8B. Accordingly, the oxide film 28 prevents the reflection of light from the secondary electron emission pieces 24A and 24B, ensuring that undesired electrons are not emitted from the photocathode 3*a* in response to such reflected light.

Even when a small amount of light is reflected off the secondary electron emission pieces 24A or 24B, the reflected light is prevented from returning to the adjacent channel of the photocathode 3*a* by increasing the height x of the focusing pieces 23 in the axial direction. Hence, undesired electrons are not emitted from the photocathode 3*a*.

Further, partitioning parts 26 formed of light-absorbing glass are provided in the light-receiving faceplate 3 to prevent crosstalk between channels of the light-receiving faceplate 3.

Moreover, light is reliably condensed in each channel A by arranging the light-condensing lens units 32 on the outer surface 29 of the light-receiving faceplate 3 in correspondence with each channel A. Accordingly, light can be reliably injected onto the prescribed effective region within each channel A in the photocathode 3*a* while being concentrated in each channel A between the partitioning parts 26 in the light-receiving faceplate 3. Therefore, electrons emitted from the photocathode 3*a* are reliably guided into the electron multiplying path L of the corresponding channel A by the corresponding focusing pieces 23.

As described above, the photomultiplier 1 of the preferred embodiment has the photocathode 3*a* for emitting electrons in response to incident light on the light-receiving faceplate 3. The photomultiplier 1 also has the electron multiplying section 9 including a plurality of stages of the dynodes 8 for multiplying electrons emitted from the photocathode 3*a* for each channel. The photomultiplier 1 also has the focusing electrode 13 for focusing electrons in each channel between the photocathode 3*a* and the electron multiplying section 9. The photomultiplier 1 also has the anode 12 for generating an output signal for each channel on the basis of the electrons multiplied in each channel of the electron multiplying section 9. The partitioning parts 26 formed of light-absorbing glass are provided in the light-receiving faceplate 3 in correspondence with each channel. The oxide film 27 is formed through an antireflection process on the surface of each focusing piece 23 forming each channel of the focusing electrode 13. The oxide film 28 is formed through an antireflection process on the surfaces of the secondary electron emission pieces 24A and 24B used to construct channels in the first and second stage dynodes 8A and 8B. In addition, the focusing pieces 23 of the focusing electrode 13 are set to a size and shape that prevents the adjacent channels in the photocathode 3*a* from being in view from the surfaces of the secondary electron emission pieces 24A and 24B, thereby suppressing crosstalk and improving the capacity for distinguishing optical signals of each channel.

A photomultiplier of the present invention is not restricted to the above embodiments described. A lot of changes and modifications are within the scope of the claims of the present inventions.

For example, the antireflection process described above included forming the oxide film 27 on the focusing pieces 23 and forming the oxide film 28 on the secondary electron emission pieces 24, but the antireflection process is not limited to oxidation Another antireflection process can also be performed on the focusing pieces 23 and the secondary electron emission pieces 24A and 24B.

For example, a light-absorbing material can be formed on the focusing pieces 23 and the secondary electron emission pieces 24A and 24B through deposition or a similar process. A desired metal (such as aluminum) can be deposited porously over the focusing pieces 23 and the secondary electron emission pieces 24A and 24B, for example. Specifically, the stainless steel focusing pieces 23 and the secondary electron emission pieces 24A and 24B are subjected to metal (aluminum in this embodiment) deposition in a vacuum tank having a low degree of vacuum (such as about $10^{-5}$–$10^{-6}$ torr). Since the metal molecules collide with gas in their paths within the vacuum tank at a low vacuum, the metal molecules are deposited on the focusing pieces 23 and the secondary electron emission pieces 24A and 24B in large clusters. Since the resulting deposition layer is not dense, the layer can absorb light and take on a black color (black aluminum in this embodiment).

Figure 4:
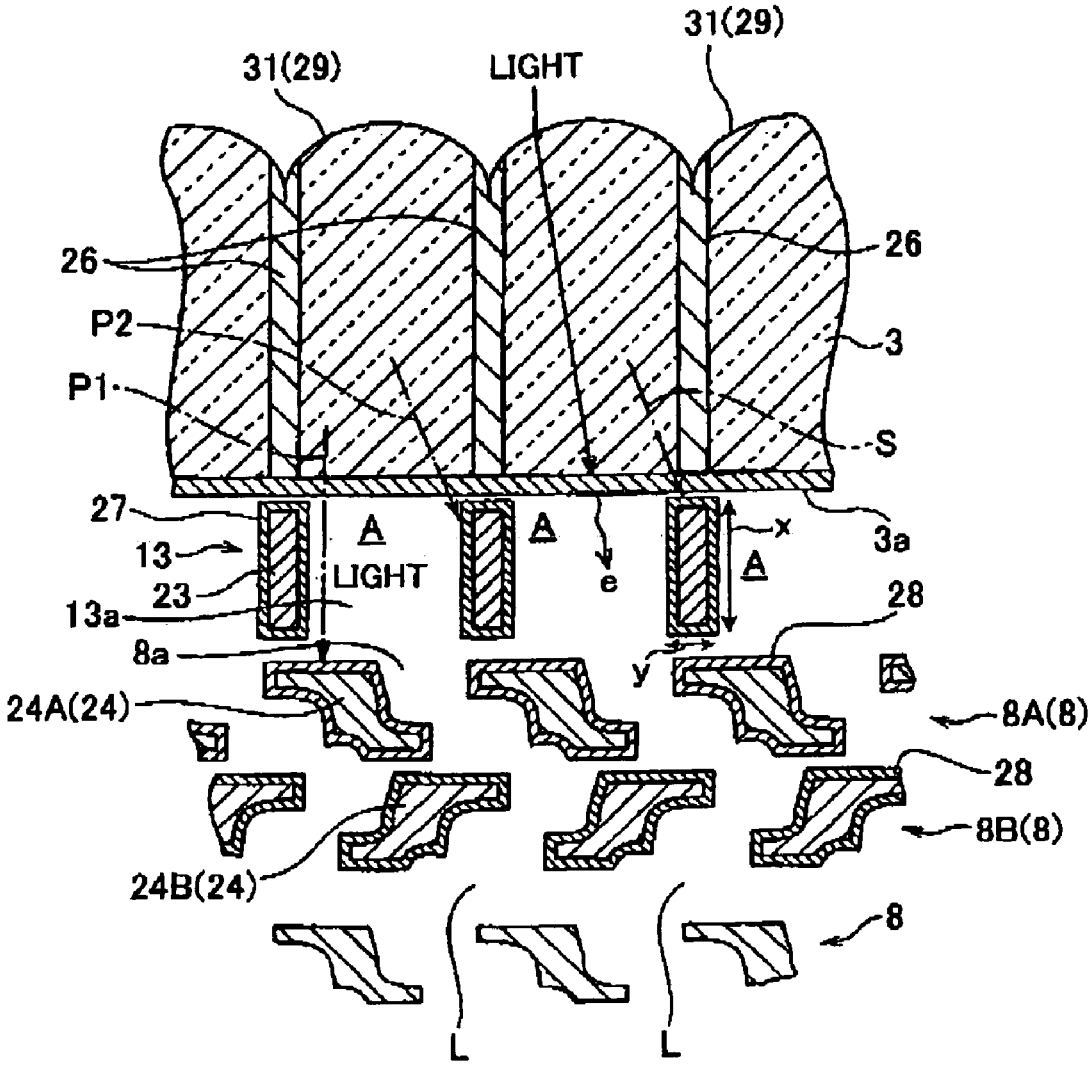
FIG. 4 is an enlarged cross-sectional view showing the relevant parts of the photomultiplier according to a variation of the preferred embodiment.
Figure 5:
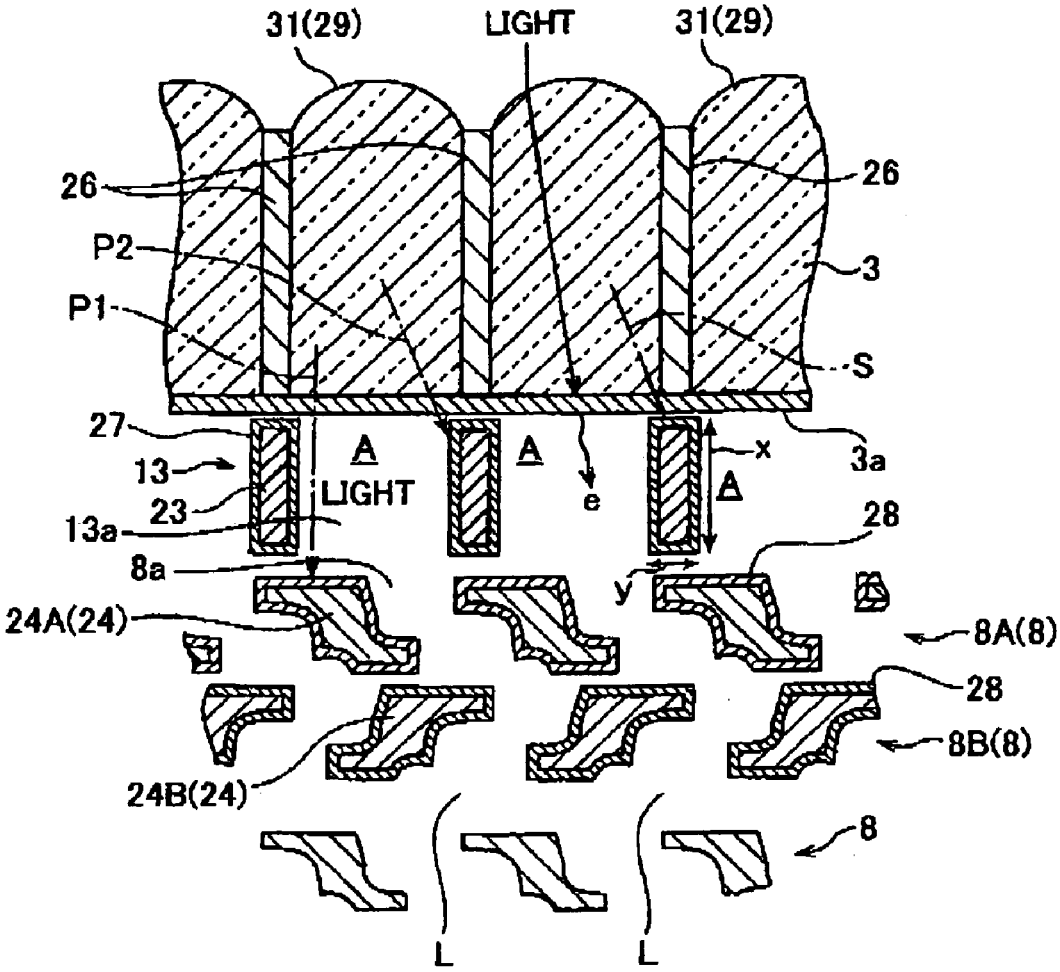
FIG. 5 is an enlarged cross-sectional view showing the relevant parts of a photomultiplier according to another variation of the preferred embodiment.

In the preferred embodiment, the light-condensing member 30 including a plurality of the convex lens surfaces 31 is provided on the light-receiving faceplate 3. However, the light-condensing member 30 may be unnecessary. For example, it is possible to form the outer surface 29 on the light-receiving faceplate 3 with a plurality of the convex lens surfaces 31, as shown in FIGS. 4 and 5. In other words, the plurality of the convex lens surfaces 31 can be formed integrally with the light-receiving faceplate 3.

In this case, adjacent convex lens surfaces 31 are joined at the partitioning parts 26. As shown in FIG. 4, the adjacent convex lens surfaces 31 can be directly joined in the top portion of the partitioning parts 26. Alternatively, as shown in FIG. 5, the top portion of the partitioning parts 26 can be formed flat and the adjacent convex lens surfaces 31 can be joined indirectly via the top portions of the partitioning parts 26.

In addition to a rectangular shape, the cross-sectional shape of the focusing pieces 23 can be formed in any desired shape, provided that the height x in the axial direction is longer than the width y. In other words, each focusing piece 23 has a size and shape enough to prevent each of the secondary electron emission pieces 24A and 24B in the dynodes of stages in view of the photocathode 3*a* (first and second stage dynodes 8A and 8B in the preferred embodiment) from having an unobstructed view of the photocathode 3*a* in adjacent channels. For example, if only the first stage dynode 8A is in view of the photocathode 3*a*, then the focusing pieces 23 are formed of a size and shape enough to prevent the secondary electron emission pieces 24A of the first stage of dynode from having an unobstructed view of the photocathode 3*a* in adjacent channels. When the first and second stage dynodes 8A and 8B are in view of the photocathode 3*a*, as in the preferred embodiment described above, then the focusing pieces 23 are formed of a size and shape enough to prevent the secondary electron emission pieces 24 for each channel of the first and second stage dynodes 8A and 8B from having an unobstructed view of the photocathode 3*a* in adjacent channels.

Similarly, if the third or later stages are in view of the photocathode 3*a*, then the focusing pieces 23 can be formed of a size and shape enough to prevent the secondary electron emission pieces 24 for each channel of the dynodes in view of the photocathode 3*a*, that is, not only the first and second stage but also the third and later stages of the dynodes 8 that are in view of the photocathode 3*a*, from having an unobstructed view of the photocathode 3*a* in adjacent channels.

In the embodiment described above, the antireflection process is performed over the entire surface of the focusing pieces 23 and the secondary electron emission pieces 24. However, this antireflection process can be performed on just a portion of this surface, such as the portion in view of the photocathode 3*a*.

Further, the focusing electrode 13 and the dynodes 8 do not need to be formed of stainless steel, but can be constructed of any material.

The electron multiplying section 9 can be any type of electron multiplying section and is not limited to a block-shaped layered type, provided that the electron multiplying section 9 is disposed back of the focusing electrode 13.

In the embodiment described above, the light-condensing member 30 including the convex lens surfaces 31 can be provided on the light-receiving faceplate 3, as shown in FIG. 3, or the convex lens surfaces 31 can be formed on the light-receiving faceplate 3 itself, as shown in FIGS. 4 and 5. However, it may be unnecessary to provide the light-condensing member 30, and the convex lens surfaces 31 need not be formed on the light-receiving faceplate 3 itself.

Further, the partitioning parts 26 need not be provided in the light-receiving faceplate 3.

In the embodiment described above, the focusing pieces 23 of the focusing electrode 13 prevent light reflected off the secondary electron emission pieces 24A and 24B of the first and second stage dynodes 8A and 8B from reaching the photocathode 3*a* of the adjacent channel. Moreover, the focusing pieces 23 and the secondary electron emission pieces 24A and 24B are treated with an antireflection process. However, it is adequate that the focusing pieces 23 can at least prevent light reflected off of the secondary electron emission pieces 24A and 24B from reaching the photocathode 3*a* of the adjacent channel. Since the focusing pieces 23 can block light even when light is reflected off of the secondary electron emission pieces 24A and 24B, the focusing pieces 23 can prevent reflected light from reaching the adjacent channels of the photocathode 3*a*, thereby suppressing crosstalk and improving the distinction of optical signals for each channel. Accordingly, it may be unnecessary to perform the antireflection process on the focusing pieces 23 and the secondary electron emission pieces 24A and 24B.

It is further possible to perform the antireflection process on just the focusing pieces 23 of the focusing electrode 13, which is the member nearest the photocathode 3*a* from among all members in stages following the photocathode 3*a*.

Alternatively, the antireflection process may be performed only on each secondary electron emission pieces 24A of the first stage dynode 8A and the focusing pieces 23 of the focusing electrode 13.

In addition to performing the antireflection process on the focusing pieces 23, the antireflection process can be performed on just each secondary electron emission piece 24 in the stages of dynodes 8 that have an unobstructed view of the photocathode 3*a* according to the arrangement of the plurality of stages of the dynodes 8. For example, when only the first stage of the dynodes 8 is in view from the photocathode 3*a*, the antireflection process can be performed only on the secondary electron emission pieces 24A in the first stage dynode 8A. When both the first and second stage dynodes 8 are in view of the photocathode 3*a*, as in the embodiment described above, then the antireflection process can be performed on the secondary electron emission pieces 24A and 24B of the first and second stage dynodes 8A and 8B. When the third stage or later stages are in view of the photocathode 3*a*, the antireflection process can be performed on each secondary electron emission piece 24 of all dynodes in view of the photocathode 3*a*, that is, the third or later stages of dynodes 8 in view of the photocathode 3*a*, in addition to the first and second stages.

INDUSTRIAL APPLICABILITY

The photomultiplier according to the present invention has a wide range of applications for detecting weak light, as in laser scanning microscopes or DNA sequencers used for detection.

The invention claimed is:

1. A photomultiplier comprising:

a light-receiving faceplate;

a wall section forming a vacuum space with the light-receiving faceplate;

a photocathode formed inside the vacuum space on an inner surface of the light-receiving faceplate and having a plurality of channels, wherein each channel emits electrons in response to light incident thereon;

an electron multiplying section disposed inside the vacuum space and having a plurality of secondary electron multiplying pieces having a one-on-one correspondence with the plurality of channels for multiplying electrons emitted from each channel in the photocathode for the corresponding channel;

an anode disposed within the vacuum space for generating an output signal for each channel based on the electrons multiplied for each channel by the electron multiplying section; and a focusing electrode disposed in the vacuum space and having a plurality of focusing pieces, wherein two adjacent focusing pieces define an opening corresponding to one channel, such that electrons emitted from corresponding channel of the photocathode are focused by the opening and guided to the corresponding channel of the electron multiplying section, and the adjacent focusing pieces are configured to prevent extraneous light reflected off the surface of secondary electron multiplying pieces in the corresponding channel of the electron multiplying section from reaching channels adjacent to the corresponding channel of the photocathode.

2. A photomultiplier according to claim 1, wherein the adjacent focusing pieces each focus electrons emitted from a prescribed region within the corresponding channel of the photocathode, and the light-receiving faceplate includes condensing means for condensing light incident on any position within each channel to a prescribed region in the corresponding channel of the photocathode.

3. A photomultiplier according to claim 2, wherein the condensing means comprises a plurality of condensing lenses disposed on an outer surface of the light-receiving faceplate in a one-on-one correspondence with the plurality of channels.

4. A photomultiplier according to claim 2, wherein the condensing means comprises a plurality of condensing lens-shaped parts formed on an outer surface of the light-receiving faceplate in a one-on-one correspondence with the plurality of channels.

5. A photomultiplier according to claim 1, wherein a surface of each focusing piece has been treated with an antireflection process.

6. The photomultiplier according to claim 1, wherein one channel faces the corresponding opening defined by the adjacent focusing pieces.

7. The photomultiplier according to claim 1, wherein each of the plurality of focusing pieces has a rectangular cross-section in which a major side extends in an axial direction of the photomultiplier.

8. A photomultiplier comprising:

a light-receiving faceplate;

a wall section forming a vacuum space with the light-receiving faceplate;

a photocathode formed on a vacuum space side of the light-receiving faceplate, the photocathode emitting an electron in response to light incident thereon;

an electron multiplying section disposed inside the vacuum space and having a plurality of secondary electron multiplying pieces for multiplying the electron emitted from the photocathode;

a focusing electrode disposed between the photocathode and the electron multiplying section, the focusing electrode having a plurality of focusing pieces, two adjacent focusing pieces define an opening which corresponds to a channel from the photocathode into the electron multiplying section, the adjacent focusing pieces each focusing the electrons passing through a corresponding opening; and an anode disposed within the vacuum space for generating an output signal based on the electron multiplied with the electron multiplying section;

wherein the adjacent focusing pieces are configured to prevent extraneous light reflected off the secondary electron multiplying piece in the corresponding channel from reaching another channel.

9. The photomultiplier according to claim 8, wherein the light-receiving faceplate comprises condensing means for condensing light incident on any position in a prescribed region of the photocathode which corresponds to each channel.

10. The photomultiplier according to claim 8, wherein the condensing means comprises a plurality of condensing lenses disposed on an outer surface of the light-receiving faceplate in a one-on-one correspondence with each channel.

11. The photomultiplier according to claim 8, wherein the condensing means comprises a plurality of condensing lens-shaped parts formed on an outer surface of the light-receiving faceplate in a one-on-one correspondence with the plurality of channels.

12. A photomultiplier according to claim 8, wherein a surface of each focusing piece has been treated with an antireflection process.

13. The photomultiplier according to claim 8, wherein each of the plurality of focusing pieces has a rectangular cross-section in which a major side extends in an axial direction of the photomultiplier.

* * * * *